US006406826B1

(12) United States Patent
Suzuki et al.

(10) Patent No.: US 6,406,826 B1
(45) Date of Patent: Jun. 18, 2002

(54) CARRIER FOR IMAGE DEVELOPER FOR ELECTROPHOTOGRAPHY

(75) Inventors: Kousuke Suzuki, Suntoh-gun; Satoshi Mochizuki; Yasuo Asahina, both of Numazu; Tomomi Suzuki, Gotenba, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/692,706

(22) Filed: Oct. 19, 2000

(30) Foreign Application Priority Data

Oct. 20, 1999 (JP) ..... 11-298892
Sep. 29, 2000 (JP) ..... 2000-298153

(51) Int. Cl.[7] ..... G03G 9/113
(52) U.S. Cl. ..... 430/111.35; 430/111.4
(58) Field of Search ..... 430/111.35, 111.4

(56) References Cited

U.S. PATENT DOCUMENTS 5,849,448 A * 12/1998 Yoshino et al. ..... 430/108
6,042,982 A * 3/2000 Hakata ..... 430/108

* cited by examiner

*Primary Examiner*—John Goodrow
(74) *Attorney, Agent, or Firm*—Cooper & Dunham LLP

(57) ABSTRACT

A carrier for an image developer for electrophotography, including a core material, and a coating layer covering the core material and containing a binder and a powder having an average particle diameter of D $\mu$m and a specific resistance of at least $10^{12}$ $\Omega$·cm. The coating layer has a thickness of h $\mu$m. The ratio D/h is greater than 1:1 but less than 5:1.

11 Claims, No Drawings

CARRIER FOR IMAGE DEVELOPER FOR ELECTROPHOTOGRAPHY

BACKGROUND OF THE INVENTION

This invention relates to a carrier for an image developer, to an electrostatic latent image developer and to an image forming apparatus by electrophotography, electrostatic recording or electrostatic printing.

In electrophotography, an electrostatic latent image formed on a photosensitive medium is developed by a developer containing a toner. A two-component developer including a carrier and a toner is widely used. Since the amount of the toner decreases during repeated use of the developer, it is necessary to replenish the developer with an amount of the toner in order to obtain images with a constant image density in a stable manner.

One known carrier for such a developer is composed of a core material covered with a resin coating. The resin coating is used for various purposes such as prevention of the formation of a toner film on the core material, provision of a smooth, non-abrasive surface, prevention of surface oxidation, prevention of moisture absorption, improvement of service life, and control of the polarity and electric charge.

However, known carriers still cause problems of adhesion of toner on the surface of the carrier (spent toner problem) and problems of wear of the resin coating during repeated use of the developer, which result in a change of surface resistivity of the carrier and deterioration of image quality. Namely, since a two-component developer is always subjected to stresses of collisions between carrier particles, between carrier particles and toner particles and between carrier particles and inside wall of a development box throughout the service time, toners are apt to firmly bond to the carrier surface. Such a spent toner is not transferred to an electrostatically charged latent image-bearing surface and thus causes deterioration of the image quality.

JP-A-H9-160304 discloses a carrier for an electrostatic latent image developer for electrophotography, including a carrier core material, and a coating layer covering the carrier core material and containing a resin and electrically conductive powder, wherein the average particle diameter B ($\mu$m) of the powder and the thickness A ($\mu$m) of the coating layer satisfy the following condition:

$$A \leqq B \leqq A+3\ \mu\text{m}.$$

In this carrier, the powder is used as a conductor for preventing an increase of the resistivity of the carrier and has a specific resistance of not greater than $10^{10}$ Ω·cm. Further, the conductive powder is used in an amount of 0.01–33.3% based on the weight of the coating layer (or 0.01–50% based on the resin of the coating layer).

SUMMARY OF THE INVENTION

It is an object of the present invention to provide a carrier for a two-component developer for electrophotography, which includes a core material covered with a resin coating layer and which is free of spent toner problems.

Another object of the present invention is to provide a carrier of the above-mentioned type which is free of problems of wear of the resin layer.

It is a further object of the present invention to provide a carrier of the above-mentioned type which can produce high quality images for a long period of time.

In accomplishing the foregoing objects, the present invention provides a carrier for an image developer for electrophotography, comprising a core material, and a coating layer covering said core material and containing a binder and a powder having an average particle diameter of D $\mu$m and a specific resistance of at least $10^{12}$ Ω·cm, said coating layer having a thickness of h $\mu$m, wherein the ratio D/h is greater than 1:1 but less than 5:1.

The term "average particle diameter" used in the present specification refers to weight average particle diameter.

The carrier is used together with a toner having a coloring agent dispersed in a binder resin as a two-component developer.

The developer is contained in a container for storage and transportation. In use, the container is mounted on an image forming apparatus such as a printer or a copying machine.

Other objects, features and advantages of the present invention will become apparent from the detailed description of the preferred embodiments of the invention to follow.

DETAILED DESCRIPTION OF THE PREFERRED EMBODIMENTS OF THE INVENTION

The according to the present invention comprises a core material, and a coating layer covering the core material.

Any conventionally employed core material for two-component developers may be used for the purpose of the present invention. Illustrative of suitable core materials are ferrite, magnetite, iron, nickel. The core material preferably has an average particle diameter of at least about 20 $\mu$m for reasons of prevention of deposition of the carrier on a latent image-bearing surface of, for example, a photoconductive drum. For reasons of image quality, The core material preferably has an average particle diameter of not greater than about 100 $\mu$m.

The coating layer of the core material has a thickness of h $\mu$m and contains a binder and a powder having an average diameter of D $\mu$m. It is important that the ratio D/h should be greater than 1:1 but less than 5:1 in order to ensure both satisfactory anti-spent toner property and satisfactory anti-wear property. When the D/h ratio is 1 or less, the powder is buried within the coating layer and cannot guard the coating layer from the friction, shock, abrasion and stress by the contact and collision of the carrier particles. To large a D/h ratio of 5 or more, on the other hand, is undesirable, because the powder cannot be tightly secured by the coating layer. The D/h ratio is preferably 1–4.

It is also important that the powder incorporated into the coating layer have a specific resistance of at least $10^{12}$ Ω·cm. Because of the high specific resistance, even when the powder secured to the core material by the binder is exposed on the surface of the carrier, leakage of charges does not occur. Thus, throughout its long service time, the carrier shows satisfactory charging amount and stable chargeability. When the specific resistance of the powder is less than $10^{12}$ Ω·cm, leakage of the charge on the carrier occurs through the powder.

Any powder may be used for the purpose of the present invention as long as the specific resistance thereof is at least $10^{12}$ Ω·cm. Surface-treated or non-treated inorganic oxide powder may be used. The surface treatment may be to impart hydrophobicity to the powder. Illustrative of suitable powder are alumina (non-treated or surface-treated) and silica (non-treated or surface-treated). The powder preferably has an average particle diameter of about 0.05 to about 5 $\mu$m.

Any binder customarily used for coating a core material of carriers may be employed in the present invention.

Examples of the binder include polystyrene resins, polyacryllc resins, polymethacrylic resins, polyolefin resins, polyamide resins, polycarbonate resins, polyether resins, polysulfinic acid resins, polyester resins, epoxy resins, polybutyral resins, urea resins, urethane-urea resins, silicone resins, teflon resins, copolymers thereof including block copolymers and graft copolymers, and mixtures thereof.

A binder resin obtained by crosslinking an acrylic resin with an amino resin is particularly suitably used for reasons of improved durability and service life of the carrier. The acrylic resin preferably has a glass transition point Tg of 20–100° C., more preferably 25–90° C., most preferably 25–80° C., since the coating layer can exhibit suitable elasticity and can absorb the shock of collision of the carrier during use. The amino resin for crosslinking the acrylic resin may be, for example, a guanamine resin or a melamine resin.

The amount of the powder in the coating layer is preferably 50–95% by weight, more preferably 60–90% by weight, most preferably 70–90% by weight. Too large an amount of the powder in excess of 95% by weight will cause reduction of chargeability of the carrier as well as release of the powder from the carrier during use. An amount of the powder below 50% by weight will be insufficient to provide desired anti-spent toner and anti-wear properties.

The coating layer preferably has a thickness h of 0.05–1.0 $\mu$m, more preferably 0.06–0.8 $\mu$m, most preferably 0.1–0.7 $\mu$m.

The coating layer of the carrier may include one or more additives such as a resistivity controlling agent (e.g. carbon black) and an acid catalyst. The acid catalyst which may be, for example, a compound having an alkyl group or a reactive group such as a methylol group, an imino group or both methylol and imino groups, serves to function as a promotor for crosslinking of an acrylic resin with an amino resin.

The following examples will further illustrate the present invention. Parts and percentages are by weight.

EXAMPLE 1

The following components were mixed with a homomixer for 1 minutes to prepare a resin layer coating liquid.

| | |
|---|---|
| Silicone resin solution (SR2411 manutactured by Dow Corning-Toray Silicone Co., Ltd., solid content: 15%) | 227 parts |
| γ-(2-Aminoethyl) aminopropyl trimethoxysilane | 6 parts |
| Alumina particles (average, particle diameter: 0.3 $\mu$m, specific resistance: $10^{14}$ Ω · cm) | 160 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Spira Coater (manufactured by Okada Seikousha Inc.) and dried to form a resin coating layer. The amount of alumina powder in the resin coating layer was 80%. The coated particles were then calcined at 300° C. for 2 hours in an electric oven and the resulting bulk of the ferrite particles were crushed and sieved with a sieve having a sieve opening of 100 $\mu$m to obtain a carrier. The carrier was found to have a thickness of the resin coating of 0.15 $\mu$m by measurement of cross-sections of the carrier layer with a transmission electron microscope. The thus obtained carrier was subjected to a running test in which 300,000 copies were continuously produced using a digital full color copier (IMAGIO Color 2800 manufactured by Ricoh Company, Ltd.) using a single black color toner (weight ratio of carrier to toner: 95:5). The resulting carrier after the running test was then measured for a reduction of charging amount and a reduction of resistivity thereof. The results are shown in Table 1.

The reduction of the charging amount ΔQ was measured by blow-off method using MODEL TB-200 (manufactured by Toshiba Chemical Co., Ltd.). Thus, the mounts of charging of the carrier before the running test (Q1) and after the running test (Q2) were measured, from which ΔQ was calculated according to the following formula:

$$\Delta Q = Q1 - Q2$$

ΔQ of less than 7.0 $\mu$c/g is desirable. The reduction of the charging amount is attributed to adhesion of spent toner to surfaces of the carrier. Thus, a low ΔQ is ascribed to low adhesion of toner.

The reduction of resistivity ΔR was measured as follows. Toner was removed from the developer by a blow-off treatment. The resulting carrier was measured for its resistivity. Thus, the carrier was charged between a pair of parallel electrodes spaced apart a distance of 2 mm. DC voltage of 200 V was then impressed between the electrodes and the resistivity after 30 seconds was measured. The measured resistivity was converted into a volume resistivity. From the volume resistivities of the carriers before the running test (R1) and after the running test (R2), ΔR was calculated according to the following formula:

$$\Delta R = R1 - R2$$

ΔR of less than 2.0 Log(Ω·cm) ($10^2$ Ω·cm) is desirable. The reduction of the resistivity is attributed to wear of the resin layer of the carrier. Thus, a low ΔR is ascribed to low wear of the resin layer.

EXAMPLE 2

The following components were mixed with a homomixer for 10 minutes to prepare a resin layer coating liquid.

| | |
|---|---|
| Acrylic resin solution (solid content: 50%) | 56 parts |
| Guanamine solution (solid content: 77%) | 15.6 parts |
| Alumina particles (average particle diameter: 0.3 $\mu$m, specific resistance: $10^{14}$ Ω · cm) | 160 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Spira Coater (manufactured by Okada Seikousha Inc.) and dried to form a resin coating layer. The amount of alumina powder in the resin coating layer was 80%. The coated particles were then calcined at 150° C. for 1 hour in an electric oven and the resulting bulk of the ferrite particles were crushed and sieved with a sieve having a sieve opening of 100 $\mu$m to obtain a carrier. The carrier was found to have a thickness of the resin coating of 0.15 $\mu$m by measurement of cross-sections of the carrier with a transmission electron microscope. The thus obtained carrier was subjected to a running test in the same manner as that in Example 1. The resulting carrier after the running test was then measured for a reduction of charging amount and a reduction of resistivity thereof. The results are shown in Table 1.

EXAMPLE 3

The following components were mixed with a homomixer for 10 minutes to prepare a resin layer coating liquid.

| | |
|---|---|
| Acrylic resin solution (solid content: 50%) | 56 parts |
| Guanamine solution (solid content: 77%) | 15.6 parts |
| Silica particles (average particle diameter: 0.2 $\mu$m, specific resistance: $10^{13}$ $\Omega \cdot$ cm) | 160 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Spira Coater (manufactured by Okada Seikousha Inc.) and dried to form a resin coating layer. The amount of silica powder in the resin coating layer was 80%. The coated particles were then calcined at 150° C. for 1 hour in an electric oven and the resulting bulk of the ferrite particles were crushed and sieved with a sieve having a sieve opening of 100 $\mu$m to obtain a carrier. The carrier was found to have a thickness of the resin coating of 0.10 $\mu$m by measurement of cross-sections of the carrier with a transmission electron microscope. The thus obtained carrier was subjected to a running test in the same manner as that in Example 1. The resulting carrier after the running test was then measured for a reduction of charging amount and a reduction of resistivity thereof. The results are shown in Table 1.

EXAMPLE 4

The following components were mixed with a homomixer for 10 minutes to prepare a resin layer coating liquid.

| | |
|---|---|
| Acrylic resin solution (solid content: 50%) | 30 parts |
| Guanamine solution (solid content: 77%) | 8.3 parts |
| Silica particles (average particle diameter: 0.2 $\mu$m, specific resistance: $10^{13}$ $\Omega \cdot$ cm) | 160 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Spira Coater (manufactured by Okada Seikousha Inc.) and dried to form a resin coating layer. The amount of alumina powder in the resin coating layer was 88.2%. The coated particles were then calcined at 150° C. for 1 hour in an electric oven and the resulting bulk of the ferrite particles were crushed and sieved with a sieve having a sieve opening of 100 $\mu$m to obtain a carrier. The carrier was found to have a thickness of the resin coating of 0.08 $\mu$m by measurement of cross-sections of the carrier with a transmission electron microscope. The thus obtained carrier was subjected to a running test in the same manner as that in Example 1. The resulting carrier after the running test was then measured for a reduction of charging amount and a reduction of resistivity thereof. The results are shown in Table 1.

COMPARATIVE EXAMPLE 1

The following components were mixed with a homomixer for 10 minutes to prepare a resin layer coating liquid.

| | |
|---|---|
| Acrylic resin solution (solid content: 50%) | 56 parts |
| Guanamine solution (solid content: 77%) | 15.6 parts |
| Titanium oxide particles (average particle diameter: 0.02 $\mu$m, specific resistance: $10^{7}$ $\Omega \cdot$ cm) | 26.7 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Spira Coater (manufactured by Okada Seikousha Inc.) and dried to form a resin coating layer. The amount of titanium oxide powder in the resin coating layer was 40%. The coated particles were then calcined at 150° C. for 1 hour in an electric oven and the resulting bulk of the ferrite particles were crushed and sieved with a sieve having a sieve opening of 100 $\mu$m to obtain a carrier. The carrier was found to have a thickness of the resin coating of 0.15 $\mu$m by measurement of cross-sections of the carrier with a transmission electron microscope. The thus obtained carrier was subjected to a running test in the same manner as that in Example 1. The resulting carrier after the running test was then measured for a reduction of charging amount and a reduction of resistivity thereof. The results are shown in Table 1.

COMPARATIVE EXAMPLE 2

The following components were mixed with a homomixer for 10 minutes to prepare a resin layer coating liquid.

| | |
|---|---|
| Acrylic resin solution (solid content: 50%) | 56 parts |
| Guanamine solution (solid content: 77%) | 15.6 parts |
| Zinc oxide particles (average particle diameter: 0.3 $\mu$m, specific resistance: $10^{7}$ $\Omega \cdot$ cm) | 160 parts |
| Toluene | 900 parts |
| Butyl cellosolve | 900 parts |

Ferrite particles, as a carrier core material, having an average particle diameter of 50 $\mu$m (F-300 manufactured by Powder Tec Co., Ltd) were coated with the above coating liquid using a Splra Coater (manufactured by Okada Seikousha Inc.) and dried to form a resin coating layer. The amount of alumina powder in the resin coating layer was 80%. The coated particles were then calcined at 150° C. for 1 hour in an electric oven and the resulting bulk of the ferrite particles were crushed and sieved with a sieve having a sieve opening of 100 $\mu$m to obtain a carrier. The carrier was found to have a thickness of the resin coating of 0.15 $\mu$m by measurement of cross-sections of the carrier with a transmission electron microscope. The thus obtained carrier was subjected to a running test in the same manner as that in Example 1. The resulting carrier after the running test was then measured for a reduction of charging amount and a reduction of resistivity thereof. The results are shown in Table 1.

TABLE 1

| | Example | | | | Comp. Exam. | |
|---|---|---|---|---|---|---|
| | 1 | 2 | 3 | 4 | 1 | 2 |
| Powder | $Al_2O_3$ | $Al_2O_3$ | $SiO_2$ | $Al_2O_3$ | $TiO_2$ | ZnO |
| Specific Resistance (Ω · cm) | $10^{14}$ | $10^{14}$ | $10^{14}$ | $10^{14}$ | $10^7$ | $10^7$ |
| D/h *1 | 2.0 | 2.0 | 2.0 | 3.8 | 0.13 | 2.0 |
| Initial Resistivity [Log (Ω · cm)] *2 | 14.5 | 14.3 | 13.6 | 13.9 | 11.2 | 9.4 |
| Reduction of Charging Amount ΔQ (μc/g) | 4.5 | 2.3 | 3.7 | 3.1 | not measured *3 | not measured *4 |
| Reduction of Resistivity ΔR [Log (Ω · cm)] | 1.2 | 0.7 | 1.3 | 0.9 | not measured *3 | not measured *4 |

*1: D/h is a ratio of the average particle diameter of powder in the resin coating to the thickness of the resin coating
*2: Initial resistivity is the resisitivity of the carrier before the running test
*3: The running test was stopped after only 30,000 copies had been produced, because the image quality became poor.
*4: After an early stage of the running test, image defects were observed. The running test was not further proceeded.

As will be appreciate from the results summarized in Table 1 above, the carriers of Examples 1–4 containing alumina or silica powder having a specific resistance of at least $10^{12}$ Ω·cm give ΔQ of less than 7.0 μc/g and ΔR of less than $10^2$ Ω·cm and do not cause problems of adhesion of spent toner to carrier surfaces and problems of wear of the resin coating. Thus, the carrier according to the present invention can produce high quality images for a long period of time. When an acrylic resin crosslinked with an amino resin is used as a binder of the resin coating layer for the carrier, the service life of the carrier is further improved.

When a powder having a specific resistance of $10^7$ Ω·cm is used in an amount of 40% (Comparative Example 1), the durability or service life of the carrier is very short. With an amount of powder of 80% (Comparative Example 2), the resistivity is so low that a current flows between the developer and the photosensitive drum to cause a damage of a surface of the drum. Such a surface damage results in image defects.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A carrier for an image developer for electrophotography, comprising a core material, and a coating layer covering said core material and containing a binder and a powder having an average particle diameter of D μm and a specific resistance of at least $10^{12}$ Ω·cm, said coating layer having a thickness of h μm, wherein the ratio D/h is greater than 1:1 but less than 5:1.

2. A carrier as claimed in claim 1, wherein said powder is selected from the group consisting of alumina powder and silica powder.

3. A carrier as claimed in claim 1, wherein said powder is present in an amount of 50–95% based on the weight of said coating layer.

4. A carrier as claimed in claim 1, wherein said powder is present in an amount of 70–90% based on the weight of said coating layer.

5. A carrier as claimed in claim 1, wherein said coating layer has a thickness h of 0.05–1.0 μm.

6. A carrier as claimed in claim 1, wherein said binder is a resin obtained by crosslinking an acrylic resin with an amino resin.

7. A carrier as claimed in claim 6, wherein said acrylic resin has a glass transition point Tg of 20–100° C.

8. A developer for electrophotography, comprising a toner having a coloring agent dispersed in a binder resin, and a carrier according to claim 1.

9. A container containing a developer according to claim 8.

10. An image forming apparatus having a container according to claim 9.

11. A carrier as recited in claim 1, wherein the powder has an average particle diameter of about 0.05–5 μm.

* * * * *